US008097388B2

(12) United States Patent
Heuft et al.

(10) Patent No.: US 8,097,388 B2
(45) Date of Patent: Jan. 17, 2012

(54) CROSSLINKING OUTER LAYER AND PROCESS FOR PREPARING THE SAME

(75) Inventors: Matthew A. Heuft, Oakville (CA); Nan-Xing Hu, Oakville (CA); Jennifer A. Coggan, Cambridge (CA); Vladislav Skorokhod, Mississauga (CA); Yvan Gagnon, Mississauga (CA); Sarah Kavassalis, Oakville (CA)

(73) Assignee: Xerox Corporation, Norwalk, CT (US)

( * ) Notice: Subject to any disclaimer, the term of this patent is extended or adjusted under 35 U.S.C. 154(b) by 978 days.

(21) Appl. No.: 12/049,187

(22) Filed: Mar. 14, 2008

(65) Prior Publication Data

US 2009/0233197 A1 Sep. 17, 2009

(51) Int. Cl.
*G03G 15/02* (2006.01)

(52) U.S. Cl. ..... 430/58.7; 430/48; 430/66; 430/58.75; 430/59.6

(58) Field of Classification Search ..... 430/48, 430/66, 59.6, 58.75, 109.4
See application file for complete search history.

(56) References Cited

U.S. PATENT DOCUMENTS

| | | | | |
|---|---|---|---|---|
| 3,121,006 | A | 2/1964 | Middleton et al. | |
| 4,265,990 | A | 5/1981 | Stolka et al. | |
| 5,399,452 | A * | 3/1995 | Takegawa et al. | 430/59.6 |
| 6,337,166 | B1 * | 1/2002 | Chambers et al. | 430/59.6 |
| 2004/0101774 | A1 * | 5/2004 | Yoshimura et al. | 430/66 |
| 2006/0216619 | A1 * | 9/2006 | Iwasaki et al. | 430/58.75 |
| 2007/0254224 | A1 * | 11/2007 | Sugino | 430/58.35 |

* cited by examiner

*Primary Examiner* — Mark F Huff
*Assistant Examiner* — Rashid Alam
(74) *Attorney, Agent, or Firm* — Pillsbury Winthrop Shaw Pittman LLP

(57) ABSTRACT

The presently disclosed embodiments are directed to an improved low wear overcoat for an imaging member having a substrate, a charge transport layer, and an overcoat positioned on the charge transport layer, and a process for preparing the same including combining a binder, a hole transport molecule, a melamine formaldehyde crosslinking agent and an acid catalyst dissolved in an alcohol solvent to form an overcoat solution, and subsequently providing the overcoat solution onto the charge transport layer to form an overcoat layer.

13 Claims, 1 Drawing Sheet

CROSSLINKING OUTER LAYER AND PROCESS FOR PREPARING THE SAME

BACKGROUND

The presently disclosed embodiments relate generally to layers that are useful in imaging apparatus members and components, for use in electrostatographic, including digital, apparatuses. More particularly, the embodiments pertain to an improved electrostatographic imaging member having a specific overcoat solution or formulation that provides excellent mechanical properties and processes for making the same. In embodiments, the photoreceptor comprises an overcoat having specific hole transport molecules containing crosslinking sites which are separated from the hole transport molecule chromophore by a variable length spacer. Making overcoat layers from an overcoat solution or formulation that comprises such hole transport molecules has shown to reduce wear in imaging members using such overcoat layers.

Electrophotographic imaging members, e.g., photoreceptors, photoconductors, imaging members, and the like, typically include a photoconductive layer formed on an electrically conductive substrate. The photoconductive layer is an insulator in the substantial absence of light so that electric charges are retained on its surface. Upon exposure to light, charge is generated by the photoactive pigment, and under applied field charge moves through the photoreceptor and the charge is dissipated.

In electrophotography, also known as xerography, electrophotographic imaging or electrostatographic imaging, the surface of an electrophotographic plate, drum, belt or the like (imaging member or photoreceptor) containing a photoconductive insulating layer on a conductive layer is first uniformly electrostatically charged. The imaging member is then exposed to a pattern of activating electromagnetic radiation, such as light. Charge generated by the photoactive pigment move under the force of the applied field. The movement of the charge through the photoreceptor selectively dissipates the charge on the illuminated areas of the photoconductive insulating layer while leaving behind an electrostatic latent image. This electrostatic latent image may then be developed to form a visible image by depositing oppositely charged particles on the surface of the photoconductive insulating layer. The resulting visible image may then be transferred from the imaging member directly or indirectly (such as by a transfer or other member) to a print substrate, such as transparency or paper. The imaging process may be repeated many times with reusable imaging members.

An electrophotographic imaging member may be provided in a number of forms. For example, the imaging member may be a homogeneous layer of a single material such as vitreous selenium or it may be a composite layer containing a photoconductor and another material. In addition, the imaging member may be layered. These layers can be in any order, and sometimes can be combined in a single or mixed layer.

Typical multilayered photoreceptors or imaging members have at least two layers, and may include a substrate, a conductive layer, an optional charge blocking layer, an optional adhesive layer, a photogenerating layer (sometimes referred to as a "charge generation layer," "charge generating layer," or "charge generator layer"), a charge transport layer, an optional overcoating layer and, in some belt embodiments, an anticurl backing layer. In the multilayer configuration, the active layers of the photoreceptor are the charge generation layer (CGL) and the charge transport layer (CTL).

The term "photoreceptor" or "photoconductor" is generally used interchangeably with the terms "imaging member."

The term "electrostatographic" includes "electrophotographic" and "xerographic." The terms "charge transport molecule" are generally used interchangeably with the terms "hole transport molecule."

One type of composite photoconductive layer used in xerography is illustrated in U.S. Pat. No. 4,265,990, which describes a photosensitive member having at least two electrically operative layers. One layer comprises a photoconductive layer which is capable of photogenerating holes and injecting the photogenerated holes into a contiguous charge transport layer (CTL). Generally, where the two electrically operative layers are supported on a conductive layer, the photoconductive layer is sandwiched between a contiguous CTL and the supporting conductive layer. Alternatively, the CTL may be sandwiched between the supporting electrode and a photoconductive layer. Photosensitive members having at least two electrically operative layers, as disclosed above, provide excellent electrostatic latent images when charged in the dark with a uniform negative electrostatic charge, exposed to a light image and thereafter developed with finely divided electroscopic marking particles. The resulting toner image is usually transferred to a suitable receiving member such as paper or to an intermediate transfer member which thereafter transfers the image to a member such as paper.

In the case where the charge-generating layer (CGL) is sandwiched between the CTL and the electrically conducting layer, the outer surface of the CTL is charged negatively and the conductive layer is charged positively. The CGL then should be capable of generating electron hole pair when exposed image wise and inject only the holes through the CTL. In the alternate case when the CTL is sandwiched between the CGL and the conductive layer, the outer surface of CGL layer is charged positively while conductive layer is charged negatively and the holes are injected through from the CGL to the CTL. The CTL should be able to transport the holes with as little trapping of charge as possible. In flexible web like photoreceptor the charge conductive layer may be a thin coating of metal on a thin layer of thermoplastic resin.

In a typical machine design, a drum photoreceptor is coated with one or more coatings applied by well known techniques such as dip coating or spray coating. Dip coating of drums usually involves immersing of a cylindrical drum while the axis of the drum is maintained in a vertical alignment during the entire coating and subsequent drying operation. Because of the vertical alignment of the drum axis during the coating operation, the applied coatings tend to be thicker at the lower end of the drum relative to the upper end of the drum due to the influence of gravity on the flow of the coating material. Coatings applied by spray coating can also be uneven, e.g., orange peel effect. Coatings that have an uneven thickness do not have uniform electrical properties at different locations of the coating. Under a normal machine imaging function condition, the photoreceptor is subjected to physical/mechanical/electrical/chemical species actions against the layers due to machine subsystems interactions. These machine subsystems interactions contribute to surface contamination, scratching, abrasion and rapid surface wear problems.

As electrophotography advances, the complex, highly sophisticated duplicating systems need to operate at very high speeds which places stringent requirements on imaging members and may reduce imaging member longevity. Thus, there is a continued need for achieving increased life span of photoconductive imaging members while maintaining good mechanical properties.

SUMMARY

According to aspects illustrated herein, there is provided an imaging member comprising: a substrate, a charge generation layer disposed on the substrate, a charge transport layer disposed on the charge generation layer, and an overcoat layer disposed on the charge transport layer, wherein the overcoat layer comprises a substantially crosslinked product obtained from a film-forming solution comprising at least a curing agent and a charge transport molecule, the charge transport molecule having at least two crosslinking sites separated from a chromophore of the charge transport molecule by a variable length spacer.

An embodiment may provide an imaging member comprising: a substrate, a charge generation layer disposed on the substrate, a charge transport layer disposed on the charge generation layer, and an overcoat layer disposed on the charge transport layer, wherein the overcoat layer comprises a substantially crosslinked product obtained from a film-forming solution comprising a polyol binder, the polyol binder being a polyester polyol, a charge transport molecule having the following structure:

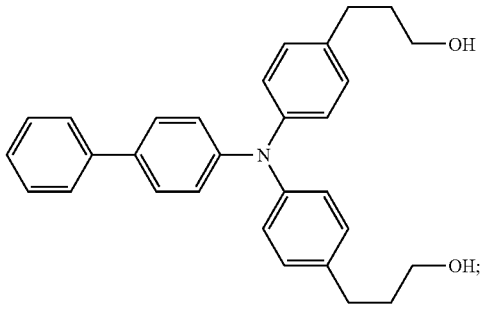

a melamine-formaldehyde resin curing agent, an organosulfonic acid or an amine salt derivative of the organosulfonic acid, and an alcohol, the alcohol being 1-methoxy-2-propanol.

Yet another embodiment, there is provided an imaging forming apparatus comprising: a charging device, a toner developer device, a cleaning device, and a photoreceptor comprising a conductive substrate, a charge generation layer, a charge transport layer, and an overcoat layer, wherein the overcoat layer comprises a substantially crosslinked product obtained from film-forming solution comprising at least a curing agent and a charge transport molecule, the charge transport molecule having at least two crosslinking sites separated from a chromophore of the charge transport molecule by a variable length spacer.

BRIEF DESCRIPTION OF THE DRAWINGS

For a better understanding, reference may be had to the accompanying figures.

DETAILED DESCRIPTION

Figure 1:
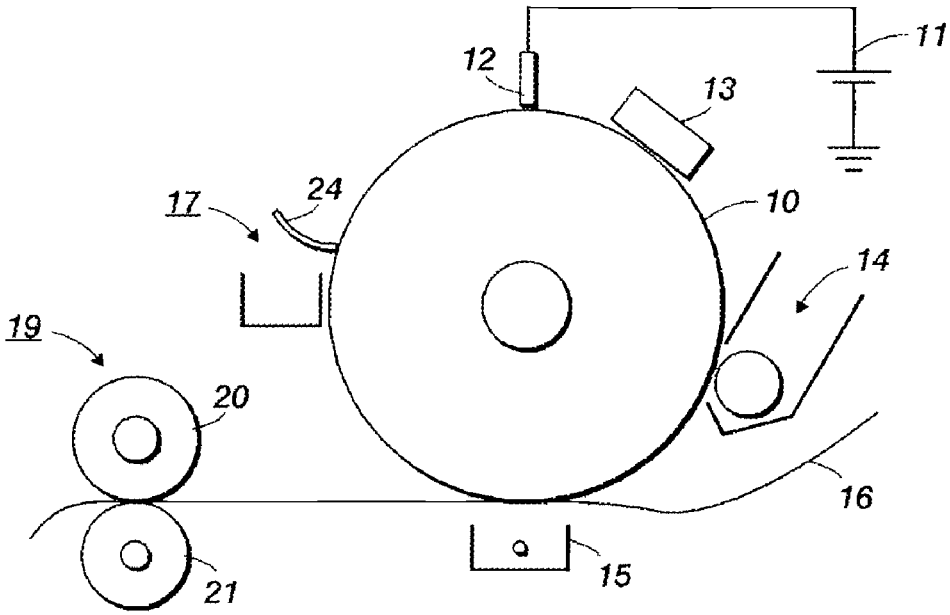
FIG. 1 is a schematic nonstructural view showing an image forming apparatus according to the present embodiments.

In the following description, reference is made to the accompanying drawings, which form a part hereof and which illustrate several embodiments. It is understood that other embodiments may be utilized and structural and operational changes may be made without departure from the scope of the present disclosure. The same reference numerals are used to identify the same structure in different figures unless specified otherwise. The structures in the figures are not drawn according to their relative proportions and the drawings should not be interpreted as limiting the disclosure in size, relative size, or location.

The presently disclosed embodiments are directed generally to an improved electrostatographic imaging member having a specific overcoat formulation that provides excellent mechanical properties, such as reduced wear, and processes for making the overcoat layer. The overcoat layer provides abrasion resistance, crack resistance and wear resistance through a crosslinked formulation comprising specific hole transport molecules having crosslinking functional groups. The hole transport molecules contain crosslinking sites which are separated from the hole transport molecule chromophore by a variable length spacer such that the crosslinking sites are not adjacent to one another.

One way to extend the lifetime of drum photoreceptors is to reduce the wear of the photoreceptor surface arising from bias charge roll (BCR) charging and cleaning. During the imaging process, the photoreceptor easily wears due to friction against toner, a roller or a cleaning blade, and consequently, the life of the photoreceptor is shortened. CTL wear-rate of current photoreceptor drums, under a standard accelerated stress test, is about 80 nm/kcycle. Thus, an overcoat layer is coated on the photoreceptor over the CTL to reduce wear and increase photoreceptor lifetime. A low wear-rate photoreceptor overcoat would have an optimal rate of less than 20 nm/kcycle in an accelerated test fixture. To date, however, such a low wear-rate overcoat has not been identified. The development of a low wear-rate photoreceptor overcoat would allow an increase in photoreceptor lifetime to greater than 400,000 cycles.

Current overcoat formulations contain either N,N'-diphenyl-N,N'-bis(3-hydroxyphenyl)-[1,1'-biphenyl]-4,4'-diamine (DHTBD) or N-(3,4-dimethylphenyl)-N,N-bis(4-hydroxymethylphenyl)-amine (DHM-TPA) hole transport molecules (shown below).

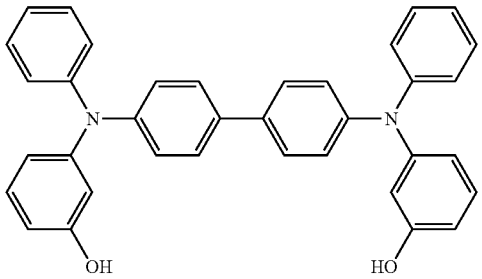

DHTBD

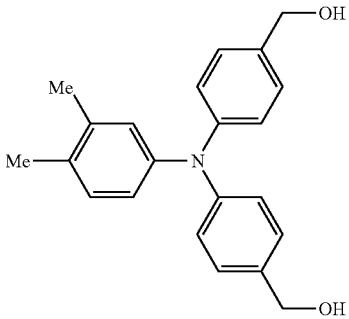

DHM-TPA

These hole transport molecules contain crosslinking groups which are directly attached to the arylamine units or the hole transporting portion of the molecule. As a result, inefficient crosslinking or charge transport may occur during the overcoat forming process and later negatively affect the overcoat layer function. In addition, DHTBD and DHM-TPA are not stable compounds.

The present embodiments provide a low wear photoreceptor overcoat formulation prepared from hole transport molecules that contain crosslinking functional groups, a binder, and a crosslinking or curing agent. Moreover, the hole transport molecules have specialized configurations that have shown to impart the optimal low wear rates to an overcoat layer that incorporates the molecules.

Referring to FIG. 1, in a typical electrostatographic reproducing apparatus, a light image of an original to be copied is recorded in the form of an electrostatic latent image upon a photosensitive member and the latent image is subsequently rendered visible by the application of electroscopic thermoplastic resin particles which are commonly referred to as toner. Specifically, photoreceptor 10 is charged on its surface by means of an electrical charger 12 to which a voltage has been supplied from power supply 11. The photoreceptor is then imagewise exposed to light from an optical system or an image input apparatus 13, such as a laser and light emitting diode, to form an electrostatic latent image thereon. Generally, the electrostatic latent image is developed by bringing a developer mixture from developer station 14 into contact therewith. Development can be effected by use of a magnetic brush, powder cloud, or other known development process.

After the toner particles have been deposited on the photoconductive surface, in image configuration, they are transferred to a copy sheet 16 by transfer means 15, which can be pressure transfer or electrostatic transfer. In embodiments, the developed image can be transferred to an intermediate transfer member and subsequently transferred to a copy sheet.

After the transfer of the developed image is completed, copy sheet 16 advances to fusing station 19, depicted in FIG. 1 as fusing and pressure rolls, wherein the developed image is fused to copy sheet 16 by passing copy sheet 16 between the fusing member 20 and pressure member 21, thereby forming a permanent image. Fusing may be accomplished by other fusing members such as a fusing belt in pressure contact with a pressure roller, fusing roller in contact with a pressure belt, or other like systems. Photoreceptor 10, subsequent to transfer, advances to cleaning station 17, wherein any toner left on photoreceptor 10 is cleaned therefrom by use of a blade 24 (as shown in FIG. 1), brush, or other cleaning apparatus.

Figure 2:
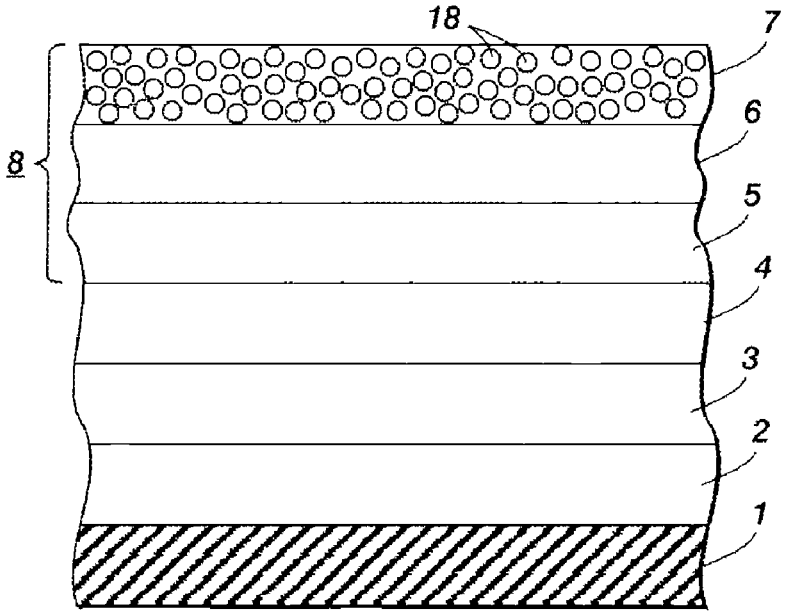
FIG. 2 is a cross-sectional view of an imaging member showing various layers according to the present embodiments.

Electrophotographic imaging members may be prepared by any suitable technique. Referring to FIG. 2, typically, a flexible or rigid substrate 1 is provided with an electrically conductive surface or coating 2. The substrate may be opaque or substantially transparent and may comprise any suitable material having the required mechanical properties. Accordingly, the substrate may comprise a layer of an electrically non-conductive or conductive material such as an inorganic or an organic composition. As electrically non-conducting materials, there may be employed various resins known for this purpose including polyesters, polycarbonates, polyamides, polyurethanes, and the like which are flexible as thin webs. An electrically conducting substrate may be any metal, for example, aluminum, nickel, steel, copper, and the like or a polymeric material, as described above, filled with an electrically conducting substance, such as carbon, metallic powder, and the like or an organic electrically conducting material. The electrically insulating or conductive substrate may be in the form of an endless flexible belt, a web, a rigid cylinder, a sheet and the like. The thickness of the substrate layer depends on numerous factors, including strength and economical considerations. Thus, for a drum, this layer may be of substantial thickness of, for example, up to many centimeters or of a minimum thickness of less than a millimeter. Similarly, a flexible belt may be of substantial thickness, for example, about 250 micrometers, or of minimum thickness less than 50 micrometers, provided there are no adverse effects on the final electrophotographic device.

Substrate

In embodiments where the substrate layer is not conductive, the surface thereof may be rendered electrically conductive by an electrically conductive coating 2. The conductive coating may vary in thickness over substantially wide ranges depending upon the optical transparency, degree of flexibility needed, and economic factors. Accordingly, for a flexible photoresponsive imaging device, the thickness of the conductive coating may be between about 20 angstroms to about 750 angstroms, or from about 100 angstroms to about 200 angstroms for an optimum combination of electrical conductivity, flexibility and light transmission. The flexible conductive coating may be an electrically conductive metal layer formed, for example, on the substrate by any suitable coating technique, such as a vacuum depositing technique or electrodeposition. Typical metals include aluminum, zirconium, niobium, tantalum, vanadium and hafnium, titanium, nickel, stainless steel, chromium, tungsten, molybdenum, and the like.

Hole Blocking Layer

An optional hole blocking layer 3 may be applied to the substrate 1 or coating. Any suitable and conventional blocking layer capable of forming an electronic barrier to holes between the adjacent photoconductive layer 8 (or electrophotographic imaging layer 8) and the underlying conductive surface 2 of substrate 1 may be used.

Adhesive Layer

An optional adhesive layer 4 may be applied to the hole-blocking layer 3. Any suitable adhesive layer well known in the art may be used. Typical adhesive layer materials include, for example, polyesters, polyurethanes, and the like. Satisfactory results may be achieved with adhesive layer thickness between about 0.05 micrometer (500 angstroms) and about 0.3 micrometer (3,000 angstroms). Conventional techniques for applying an adhesive layer coating mixture to the hole blocking layer include spraying, dip coating, roll coating, wire wound rod coating, gravure coating, Bird applicator coating, and the like. Drying of the deposited coating may be effected by any suitable conventional technique such as oven drying, infrared radiation drying, air drying and the like.

At least one electrophotographic imaging layer 8 is formed on the adhesive layer 4, blocking layer 3 or substrate 1. The electrophotographic imaging layer 8 may be a single layer (7 in FIG. 1) that performs both charge-generating and charge transport functions as is well known in the art, or it may comprise multiple layers such as a charge generator layer 5 and charge transport layer 6.

Charge Generation Layer

The charge generating layer 5 can be applied to the electrically conductive surface, or on other surfaces in between the substrate 1 and charge generating layer 5. A charge blocking layer or hole-blocking layer 3 may optionally be applied to the electrically conductive surface prior to the application of a charge generating layer 5. An adhesive layer 4 may be used between the charge blocking or hole-blocking layer 3 and the charge generating layer 5. Usually, the charge generation layer 5 is applied onto the blocking layer 3 and a charge transport layer 6, is formed on the charge generation layer 5. This structure may have the charge generation layer 5 on top of or below the charge transport layer 6.

Charge generator layers may comprise amorphous films of selenium and alloys of selenium and arsenic, tellurium, germanium and the like, hydrogenated amorphous silicon and compounds of silicon and germanium, carbon, oxygen, nitrogen and the like fabricated by vacuum evaporation or deposition. The charge-generator layers may also comprise inorganic pigments of crystalline selenium and its alloys; Group II-VI compounds; and organic pigments such as quinacridones, polycyclic pigments such as dibromo anthanthrone pigments, perylene and perinone diamines, polynuclear aromatic quinones, azo pigments including bis-, tris- and tetrakis-azos; and the like dispersed in a film forming polymeric binder and fabricated by solvent coating techniques.

Phthalocyanines have been employed as photogenerating materials for use in laser printers using infrared exposure systems. Infrared sensitivity is required for photoreceptors exposed to low-cost semiconductor laser diode light exposure devices. The absorption spectrum and photosensitivity of the phthalocyanines depend on the central metal atom of the compound. Many metal phthalocyanines have been reported and include, oxyvanadium phthalocyanine, chloroaluminum phthalocyanine, copper phthalocyanine, titanium oxide phthalocyanine, oxytitanium phthalocyanine, chlorogallium phthalocyanine, hydroxygallium phthalocyanine magnesium phthalocyanine and metal-free phthalocyanine. The phthalocyanines exist in many crystal forms, and have a strong influence on photogeneration.

Any suitable polymeric film forming binder material may be employed as the matrix in the charge-generating (photogenerating) binder layer. Typical polymeric film forming materials include those described, for example, in U.S. Pat. No. 3,121,006, the entire disclosure of which is incorporated herein by reference. Thus, typical organic polymeric film forming binders include thermoplastic and thermosetting resins such as polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, polyphenylene sulfides, polyvinyl acetate, polysiloxanes, polyacrylates, polyvinyl acetals, polyamides, polyimides, amino resins, phenylene oxide resins, terephthalic acid resins, phenoxy resins, epoxy resins, phenolic resins, polystyrene and acrylonitrile copolymers, polyvinylchloride, vinylchloride and vinyl acetate copolymers, acrylate copolymers, alkyd resins, cellulosic film formers, poly(amideimide), styrenebutadiene copolymers, vinylidenechloride-vinylchloride copolymers, vinylacetate-vinylidenechloride copolymers, styrene-alkyd resins, polyvinylcarbazole, and the like. These polymers may be block, random or alternating copolymers.

The photogenerating composition or pigment is present in the resinous binder composition in various amounts. Generally, however, from about 5 percent by volume to about 90 percent by volume of the photogenerating pigment is dispersed in about 10 percent by volume to about 95 percent by volume of the resinous binder, or from about 20 percent by volume to about 30 percent by volume of the photogenerating pigment is dispersed in about 70 percent by volume to about 80 percent by volume of the resinous binder composition. In one embodiment, about 8 percent by volume of the photogenerating pigment is dispersed in about 92 percent by volume of the resinous binder composition. The photogenerator layers can also fabricated by vacuum sublimation in which case there is no binder.

Any suitable and conventional technique may be used to mix and thereafter apply the photogenerating layer coating mixture. Typical application techniques include spraying, dip coating, roll coating, wire wound rod coating, vacuum sublimation, and the like. For some applications, the generator layer may be fabricated in a dot or line pattern. Removing of the solvent of a solvent coated layer may be effected by any suitable conventional technique such as oven drying, infrared radiation drying, air drying and the like.

Charge Transport Layer

The charge transport layer 6 may comprise a charge transporting small molecule dissolved or molecularly dispersed in a film forming electrically inert polymer such as a polycarbonate. The term "dissolved" as employed herein is defined herein as forming a solution in which the small molecule is dissolved in the polymer to form a homogeneous phase. The expression "molecularly dispersed" is used herein is defined as a charge transporting small molecule dispersed in the polymer, the small molecules being dispersed in the polymer on a molecular scale. Any suitable charge transporting or electrically active small molecule may be employed in the charge transport layer of this invention. The expression charge transporting "small molecule" is defined herein as a monomer that allows the free charge photogenerated in the transport layer to be transported across the transport layer. Typical charge transporting small molecules include, for example, pyrazolines such as 1-phenyl-3-(4'-diethylaminostyryl)-5-(4"-diethylamino phenyl)pyrazoline, diamines such as N,N'-diphenyl-N,N'-bis(3-methylphenyl)-(1,1'-biphenyl)-4,4'-diamine, hydrazones such as N-phenyl-N-methyl-3-(9-ethyl)carbazyl hydrazone and 4-diethyl amino benzaldehyde-1,2-diphenyl hydrazone, and oxadiazoles such as 2,5-bis(4-N,N'-diethylaminophenyl)-1,2,4-oxadiazole, stilbenes and the like. As indicated above, suitable electrically active small molecule charge transporting compounds are dissolved or molecularly dispersed in electrically inactive polymeric film forming materials. A small molecule charge transporting compound that permits injection of holes from the pigment into the charge generating layer with high efficiency and transports them across the charge transport layer with very short transit times is N,N'-diphenyl-N,N'-bis(3-methylphenyl)-(1,1'-biphenyl)-4,4'-diamine (TPD). Further hole transport compounds may include N,N'-diphenyl-N,N'-bis(3-methylphenyl)-(1,1'-biphenyl)-4,4'-diamine, N,N,N'N'-tetra(4-methylphenyl)-(1,1'-biphenyl)-4,4'-diamine, N,N'-bis(4-butylphenyl)-N,N'-di-p-tolyl-[p-terphenyl]-4,4"-diamine, or N,N'-bis(4-butylphenyl)-N,N'-di-m-tolyl-[p-terphenyl]-4,4"-diamine.

The charge transport material in the charge transport layer may comprise a polymeric charge transport material or a combination of a small molecule charge transport material and a polymeric charge transport material.

Any suitable electrically inactive resin binder insoluble in the alcohol solvent may be employed in the charge transport layer of this invention. Typical inactive resin binders include polycarbonate resin (such as MAKROLON), polyester, polyarylate, polyacrylate, polyether, polysulfone, and the like. Molecular weights can vary, for example, from about 20,000 to about 150,000. Examples of binders include polycarbonates such as poly(4,4'-isopropylidene-diphenylene)carbonate (also referred to as bisphenol-A-polycarbonate, poly(4,4'-cyclohexylidinediphenylene) carbonate (referred to as bisphenol-Z polycarbonate), poly(4,4'-isopropylidene-3,3'-dimethyl-diphenyl)carbonate (also referred to as bisphenol-C-polycarbonate) and the like. Any suitable charge transporting polymer may also be used in the charge transporting layer of this invention. The charge transporting polymer should be insoluble in the alcohol solvent employed to apply the overcoat layer of this invention. These electrically active charge transporting polymeric materials should be capable of supporting the injection of photogenerated holes from the charge generation material and be capable of allowing the transport of these holes there through.

Any suitable and conventional technique may be used to mix and thereafter apply the charge transport layer coating mixture to the charge generating layer. Typical application techniques include spraying, dip coating, roll coating, wire wound rod coating, and the like. Drying of the deposited coating may be effected by any suitable conventional technique such as oven drying, infrared radiation drying, air drying and the like.

Generally, the thickness of the charge transport layer is between about 10 and about 50 micrometers, but thicknesses outside this range can also be used. The hole transport layer should be an insulator to the extent that the electrostatic charge placed on the hole transport layer is not conducted in the absence of illumination at a rate sufficient to prevent formation and retention of an electrostatic latent image thereon. In general, the ratio of the thickness of the hole transport layer to the charge generator layers can be maintained from about 2:1 to 200:1 and in some instances as great as 400:1. The charge transport layer, is substantially non-absorbing to visible light or radiation in the region of intended use but is electrically "active" in that it allows the injection of photogenerated holes from the photoconductive layer, i.e., charge generation layer, and allows these holes to be transported through itself to selectively discharge a surface charge on the surface of the active layer.

Overcoat Layer

Traditional overcoat layers comprise a dispersion of nanoparticles, such as silica, metal oxides, ACUMIST (waxy polyethylene particles), PTFE, and the like. The nanoparticles may be used to enhance the lubricity, scratch resistance, and wear resistance of the charge transport layer 6. However, such commonly used overcoat formulations have instability problems and also exhibit higher start up and running torque than control drum photoreceptors without an overcoat layer.

In embodiments, an overcoat layer 7 is coated on the charge-transporting layer. As discussed above, and shown in FIG. 2, the overcoat layer 7 incorporates hole transport molecules 18 that provide enhanced crosslinking to the overcoat formulation and results in an overcoat layer that has substantially reduced wear. The overcoat formulation is prepared from hole transport molecules that contain crosslinking functional groups, a binder, and a crosslinking or curing agent. The hole transport molecules have structures in which the cross-linking functional groups are not attached directly to the arylamine units or the hole transporting portion of the molecule, but rather, are separated from the hole transport molecule chromophore by a variable length spacer such that the crosslinking sites are not adjacent to one another. This specialized configuration provides more efficient crosslinking and shown to impart the optimal low wear rates to an overcoat layer that incorporates the molecules. Preliminary results show photoreceptor wear-rates as low as 9 nm/kcycle have been achieved when such hole transport molecules were used to form the overcoat layer (see Examples).

In the present embodiments, the overcoat layer comprises a substantially crosslinked product obtained from a film-forming solution comprising at least a curing agent and a charge transport molecule. A substantially crosslinked product can be determined by the overcoat being undamaged when rubbed with a cotton swab moistened with the formulation coating solvent or liquid, such as 1-methoxy-2-propanol or isopropanol. The charge transport molecule has at least two crosslinking sites separated from the charge transport molecule chromophore by a variable length spacer.

In further embodiments, there is also provided processes for preparing the hole transport molecules having the configurations described above. To a prepared 3-necked round bottle flask (RBF), equipped with mechanical stirring, an addition funnel, and a condenser, a solvent such as tetrahydrofuran (THF) is added to the RBF and cooled to 0° C. with an icebath. A reducing agent, such as $LiAlH_4$, is then added to the reactor. A solution of a suitable hole transport molecule precursor in solvent is prepared. Examples of a few suitable hole transport molecules to use in the preparation are the mono-, di-, tri-, tetra-carboxylic acid derivatives of the compounds shown below. In the resulting hole transport molecules, at least two of the terminal aryl rings in the structures below would be meta- or para-substituted with ω-hydroxyalkyl groups, ω-hydroxyalkoxyl groups, and the like with chain lengths greater than 2, thus providing more efficient crosslinking.

In embodiments, R' represents a substituent selected from the group consisting of a hydrogen atom, linear or branched alkyl groups containing from about 1 to about 10 carbon atoms, ω-hydroxy-substituted alkyl groups wherein the alkyl group has from about 1 to about 10 carbon atoms, ω-hydroxy-substituted alkoxyl groups wherein the alkoxyl group has from about 1 to about 10 carbon atoms, a hydroxy-substituted aryl group, and a ω-hydroxy-substituted aralkyl group.

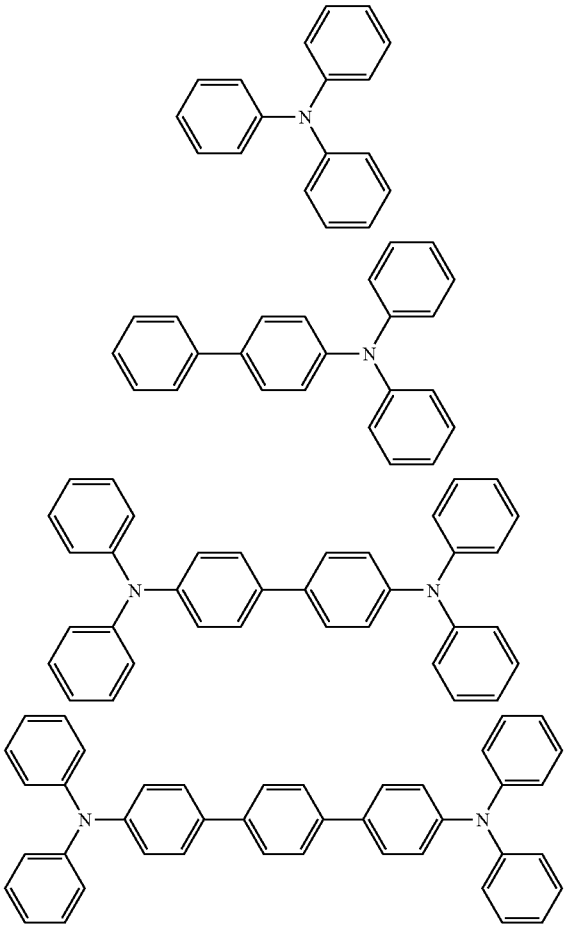

-continued

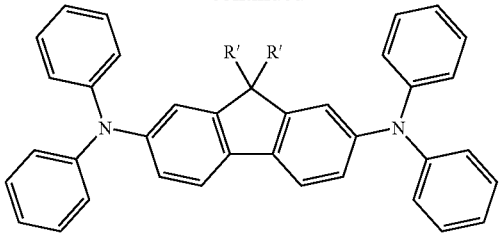

In embodiments, the charge transport molecule present in the overcoat film-forming solution is based upon on of the structures listed above and contains at least two substituents selected from the group consisting of: ω-hydroxy-substituted alkyl groups wherein the alkyl group has at least 2 to about 8 carbon atoms, ω-hydroxy-substituted alkoxyl groups wherein the alkoxyl group has at least 2 to about 8 atoms, and a ω-hydroxy-substituted aralkyl group, such that a hydroxyl crosslinking site in the charge transport molecule is separated from the charge transport molecule chromophore by at least from about 2 to about 8 atoms.

The solution is next transferred to the addition funnel, and added drop-wise to the suspension in the RBF. The reaction is warmed to room temperature and stirred until the reaction is complete. Once thin layer chromatography (TLC) confirmed no beginning hole transport molecule remained, the reaction was cooled to 0° C. and a solution, such as ethyl acetate in THF, is added drop-wise to quench excess reducing agent. Subsequent solutions, such as water in THF and NaOH and water, may be added to ease the removal of the lithium and aluminum salts. The mixture is warmed to yield a suspension and then filtered through a Celite plug. The filtrate is then extracted and the combined organic extracts are washed, dried, filtered, and concentrated to produce a solid. The crude reaction product is re-crystallized to provide a colorless powder that is dried overnight in a vacuum oven.

The resulting hole transport molecules are incorporated into an overcoat formulation with a binder, a crosslinking or curing agent, and an acid catalyst. The acid catalyst is dissolved in an alcohol solvent. The acid catalyst may be an organosulfonic acid or an amine salt derivative of the organosulfonic acid. In a particular embodiments, the formulation comprises the hole transport molecule, a polyol binder, a melamine-formaldehyde curing agent, and p-toluene sulfonic acid (p-TSA) dissolved in 1-methoxy-2-propanol or isopropanol.

In other embodiments, the formulation can also be made such that it contains no binder and/or no co-binder at all and just contains the hole transport molecule, the crosslinking or curing agent, and the acid catalyst dissolved in the alcohol solvent.

In one embodiment an imaging forming apparatus comprises a charging device, a toner developer device, a cleaning device, and a photoreceptor. The photoreceptor further comprises a conductive substrate, a charge generation layer, a charge transport layer, and an overcoat layer, and the overcoat layer comprises the substantially crosslinked product obtained from the film-forming solution. In such embodiments, the photoreceptor demonstrates wear-rate of from about 5 to about 15 nm/kcycles. In particular embodiments, the charging device is a biased charge roll.

Any suitable and conventional technique may be utilized to form and thereafter apply the overcoat layer mixture to the imaging layer. Typical application techniques include, for example extrusion coating, draw bar coating, roll coating, wire wound rod coating, and the like. The overcoat layer 7 may be formed in a single coating step or in multiple coating steps. Drying of the deposited coating may be effected by any suitable conventional technique such as oven drying, infra red radiation drying, air drying and the like. The thickness of the dried overcoat layer may depend upon the abrasiveness of the charging, cleaning, development, transfer, etc. system employed and can range up to about 10 microns. In these embodiments, the thickness can be from about 0.5 microns to about 20 microns, or from about 0.5 microns and about 15 microns in thickness. More specifically, the thickness may be from about 3 microns to about 10 microns. In specific embodiments, the hole transport molecules are present in an amount of from about 20 percent to about 80 percent by weight of the total weight of the overcoat layer, or more particularly, from about 35 percent to about 60 percent by weight of the total weight of the overcoat layer.

Various exemplary embodiments encompassed herein include a method of imaging which includes generating an electrostatic latent image on an imaging member, developing a latent image, and transferring the developed electrostatic image to a suitable substrate.

While the description above refers to particular embodiments, it will be understood that many modifications may be made without departing from the spirit thereof. The accompanying claims are intended to cover such modifications as would fall within the true scope and spirit of embodiments herein.

The presently disclosed embodiments are, therefore, to be considered in all respects as illustrative and not restrictive, the scope of embodiments being indicated by the appended claims rather than the foregoing description. All changes that come within the meaning of and range of equivalency of the claims are intended to be embraced therein.

EXAMPLES

The example set forth herein below and is illustrative of different compositions and conditions that can be used in practicing the present embodiments. All proportions are by weight unless otherwise indicated. It will be apparent, however, that the embodiments can be practiced with many types of compositions and can have many different uses in accordance with the disclosure above and as pointed out hereinafter.

Example 1

Hole Transport Molecule Preparation

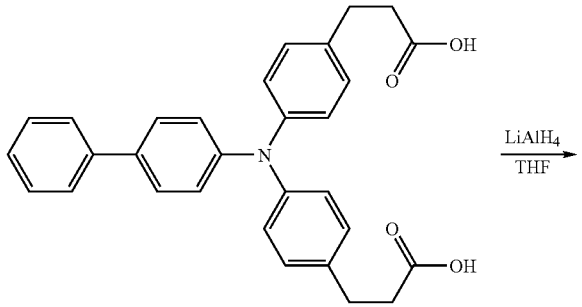

Ae-89

-continued

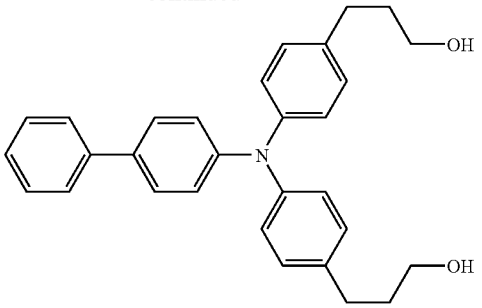

MH-1

A 3-necked, 5000 mL RBF equipped with mechanical stirring, an addition funnel, and a condenser was flame-dried and cooled under argon. THF (1600 mL) was added and cooled to 0° C. with an icebath. $LiAlH_4$ (16.3 g, 0.43 mol) was added to the reactor from a glass vial under a stream of argon. A solution of a beginning hole transport molecule, Ae-89 (50.0 g, 0.107 mol), in THF (400 mL) was prepared, transferred to the addition funnel, and added drop-wise to the $LiAlH_4$ suspension over 1 h. Ae-89 has a chemical formula of $C_{30}H_{27}NO_4$ and $M_w$=465.54.

During the addition of the Ae-89 solution, the reaction became quite viscous. The reaction was then warmed to room temperature and stirred overnight (15.5 h total). TLC (ethylene acetate) showed no Ae-89 remained (reaction time not optimized). The reaction was cooled to 0° C. and a solution of ethyl acetate (25 mL) in THF (75 mL) was added drop-wise to quench excess $LiAlH_4$. A solution of water (16.3 mL) in THF (80 mL) was added drop-wise over 30 minutes followed by a solution of NaOH (15 percent aq., 16.3 mL), and water (50 mL). The mixture was warmed to room temperature to yield a pale yellow suspension. The reaction mixture was filtered through a Celite plug with ethylene acetate and water. Water was added to the filtrate which was then twice extracted with ethylene acetate. The combined organic extracts were washed with brine, dried ($MgSO_4$), filtered, and concentrated to produce an off-white solid. The crude reaction product was recrystallized from toluene (50 mL) to produce a colorless powder that was dried overnight in a vacuum oven (37.8 g, 80 percent).

The resulting hole transport molecule, designated as MH-1 in the present application, has a chemical formula of $C_{30}H_{31}NO_2$ and $M_w$=437.57. MH-1 is a new hole transport molecule based on a diarylbiphenylamine motif. MH-1 has better solubility than other members of this compound class due to the ω-alkoxy substituents. For example, MH-1 is readily soluble in THF, chlorinated solvents, ethyl acetate, acetone, and sparingly soluble in alcohols.

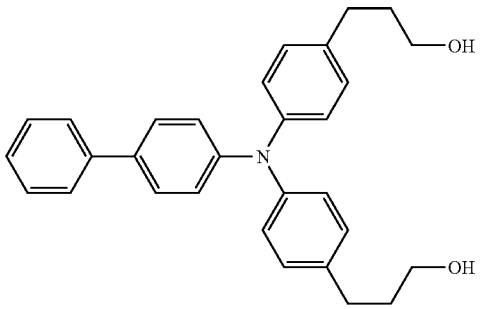

MH-1

Preparation of Overcoat Formulation

The new class of prepared hole transport materials can be incorporated into an overcoat formulation which comprises a (i) polyol binder, (ii) a melamine-formaldehyde curing agent, (iii) an HTM, and (iv) an acid catalyst (e.g., p-TSA) dissolved in a alcohol solvent such as DOWANOL or isopropanol, from which a film-forming solution is obtained. The polyol binder can comprise a polyester polyol (such as DESMOPHEN-800 from Bayer USA Inc. (Pittsburgh, Pa., USA) or an acrylic polyol (such as 7558-B60 from OPC Polymers (Columbus, Ohio, USA), or JONCRYL-587 or JONCRYL-510 from Johnson Polymers Ltd. (Studley, Warwickshire, UK)). Typically, the formulation further comprises a co-binder (such as DESMOPHEN-1652-A from Bayer or polypropylene glycol (PPG) having a molar mass of, e.g., 2000). However, the formulation could also be made such that it contains no binder and/or no co-binder.

The curing agent can include melamine-formaldehyde curing agents such as CYMEL 1130 or CYMEL 303 from Cytec Industries Inc (West Paterson, N.J., USA). The curing agent could also be an alkoxymethyl derivative of benzoguanamine or cycloalkanediylbisguanamines and their derivatives. Structures of possible curing agents are shown below.

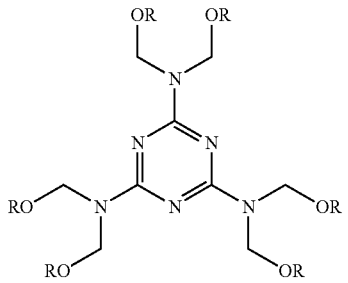

melamine-formaldehyde-based

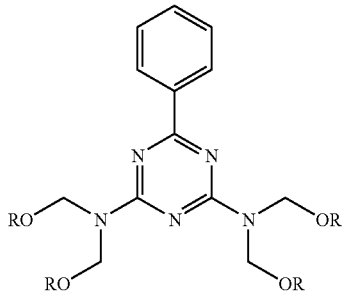

guanamine-based

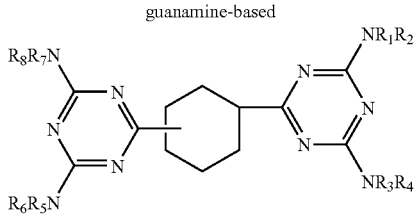

cycloalkanediylbisguanamine-based

Further curing agents may include an epoxide or isocyanate or any derivatives of the listed curing agents. Other additives could be used as well such as leveling agents, metal oxides, primary and secondary ELCO alcohols (available from Elco Corp., Cleveland, Ohio, USA), and the like.

Typical 30 mm drums were overcoated with formulations containing different binders and hole transport molecules, at 22 percent solids loading of: 24 percent binder, 35 percent CYMEL 303, 40 percent hole transport molecule and 1 percent catalyst, with a target thickness of about 3 micron.

Testing of Photoreceptor

The improved overcoat layer was tested for electrical and mechanical properties. The test results, including those regarding photon induced discharge curves (PIDC), dark decay, electrical discharge, and wear rate are shown in Table 1.

The devices were worn in a Hodaka BCR accelerated wear test fixture for 50K cycles. PIDC was measured in a 30 mm scanner, and the values of dark decay, $E_{1/2}$ (half-discharge exposure), and ΔVr (change of residual voltage due to the presence of the overcoat with respect to the non-overcoated drum) were calculated. Table 1 below shows various examples of control and experimental overcoat layers arranged by increasing wear rate. MH-1 had significantly better wear resistance than the other hole transport molecules used in the study, while preserving good electrical discharge and dark decay properties.

TABLE 1

| Binder | CTM | Catalyst | OCL Thickness (μm) | Dark Decay | $E_{1/2}$ | ΔVr | Wear nm/kC |
|---|---|---|---|---|---|---|---|
| Desmophen800 | MH-1 | Nacure5225 | 2.1 | 19 | 2.68 | 47 | 9.2 |
| Desmophen800 | MH-1 | Nacure5225 | 2.2 | 20 | 2.57 | 45 | 12.2 |
| Bisphenol A | MH-1 | Nacure5225 | 2.0 | 19 | 2.36 | 51 | 17.8 |
| Desmophen800 | DHTBD | p-TSA (m-n) | 2.4 | 17 | 2.56 | 44 | 17.8 |
| Joncryl587 | MH-1 | p-TSA (m-n) | 3.0 | 10 | 2.86 | 63 | 19.0 |
| Bisphenol A | MH-1 | Nacure5225 | 2.0 | 19 | 2.49 | 48 | 21.0 |
| Joncryl587 | MH-1 | Nacure5225 | 3.0 | 11 | 2.53 | 55 | 23.6 |
| Joncryl587 | MH-1 | Nacure5225 | 2.9 | 10 | 2.68 | 73 | 24.4 |
| Joncryl587 | MH-1 | Nacure5225 | 2.9 | 8 | 2.51 | 43 | 26.6 |
| Joncryl587 | DHTBD | p-TSA (m-n) | 3.3 | 16 | 2.48 | 50 | 31.0 |
| Joncryl587 | DHMTPA | Nacure5225 | 3.0 | 8 | 2.65 | 66 | 33.8 |
| Joncryl587 | DHMTPA | Nacure5225 | 2.6 | 11 | 2.38 | 65 | 36.2 |
| Joncryl587 | DHTBD | p-TSA (m-n) | 3.3 | 20 | 2.45 | 34 | 39.8 |
| Joncryl587 | DHTBD | p-TSA (m-n) | 3.0 | 17 | 2.35 | 30 | 40.8 |
| Joncryl587 | DHTBD | Nacure5225 | 3.1 | 21 | 2.47 | 39 | 56.8 |
| Joncryl587 | DHTBD | Nacure5225 | 3.2 | 11 | 2.42 | 49 | 61.2 |

All the patents and applications referred to herein are hereby specifically, and totally incorporated herein by reference in their entirety in the instant specification.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims. Unless specifically recited in a claim, steps or components of claims should not be implied or imported from the specification or any other claims as to any particular order, number, position, size, shape, angle, color, or material.

What is claimed is:

1. An imaging member comprising:

a substrate;

a charge generation layer disposed on the substrate;

a charge transport layer disposed on the charge generation layer; and an overcoat layer disposed on the charge transport layer, wherein the overcoat layer comprises a substantially crosslinked product obtained from a film-forming solution comprising at least a curing agent and a charge transport molecule, wherein the film-forming solution further comprises a polyester polyol and a charge transport molecule having the following structure:

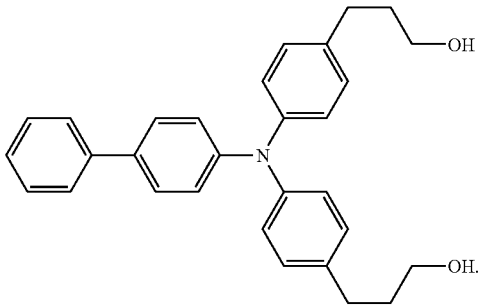

2. The imaging member of claim 1, wherein the curing agent is selected from the group consisting of a melamine-formaldehyde resin, benzoguanamine resin, cycloalkanediyl-bisguanamine resin, epoxide, isocyanate and mixtures thereof.

3. The imaging member of claim 1, wherein the overcoat film-forming solution further comprises an acid catalyst selected from the group consisting of an organosulfonic acid, an amine salt derivative of the organosulfonic acid, and mixtures thereof.

4. The imaging member of claim 1, wherein the overcoat film-forming solution is prepared in an alcohol selected from the group consisting of isopropanol, 1-methoxy-2-propanol, and mixtures thereof.

5. The imaging member of claim 1, wherein the overcoat layer has a thickness of from about 0.5 microns to about 20 microns.

6. The imaging member of claim 1, wherein the charge transport molecule is present in an amount of from about 20 percent to about 80 percent by weight of the total weight of the overcoat layer.

7. The imaging member of claim 1, wherein the charge generation layer comprises a photosensitive pigment selected from the group consisting of a metal free phthalocyanine, a hydroxygallium phthalocyanine, a chlorogallium phthalocyanine, and a titanium oxide phthalocyanine.

8. The imaging member of claim 1, wherein the charge transport layer comprises a hole transport compound selected from the group consisting of N,N'-diphenyl-N,N'-bis(3-methylphenyl)-(1,1'-biphenyl)-4,4'-diamine, N,N,N'N'-tetra(4-methylphenyl)-(1,1'-biphenyl)-4,4'-diamine, N,N'-bis(4-butylphenyl)-N,N'-di-p-tolyl-[p-terphenyl]-4,4"-diamine, and N,N'-bis(4-butylphenyl)-N,N'-di-m-tolyl-[p-terphenyl]-4,4"-diamine.

9. An imaging member comprising:

a substrate;

a charge generation layer disposed on the substrate;

a charge transport layer disposed on the charge generation layer; and an overcoat layer disposed on the charge transport layer, wherein the overcoat layer comprises a substantially crosslinked product obtained from a film-forming solution comprising:

a polyol binder, the polyol binder being a polyester polyol, a charge transport molecule having the following structure:

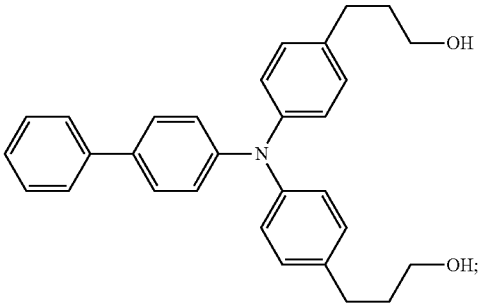

a melamine-formaldehyde resin curing agent, an organosulfonic acid or an amine salt derivative of the organosulfonic acid, and an alcohol, the alcohol being 1-methoxy-2-propanol.

10. An imaging forming apparatus comprising:

a charging device;

a toner developer device;

a cleaning device;

and a photoreceptor comprising a conductive substrate, a charge generation layer, a charge transport layer, and an overcoat layer, wherein the overcoat layer comprises a substantially crosslinked product obtained from film-forming solution comprising at least a curing agent and a charge transport molecule, wherein the film-forming solution further comprises a polyester polyol and a charge transport molecule having the following structure:

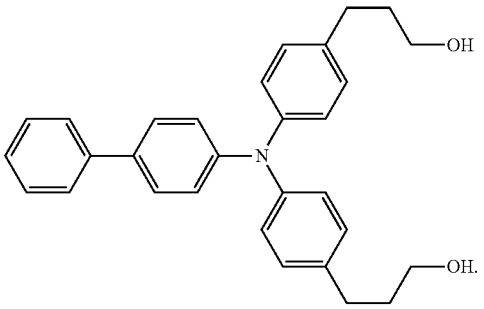

11. The imaging forming apparatus of claim 10, wherein the charge generation layer of the photoreceptor comprises a photosensitive pigment selected from the group consisting of a metal free phthalocyanine, a hydroxygallium phthalocyanine, a chlorogallium phthalocyanine, and a titanium oxide phthalocyanine, and wherein the charge transport layer of the photoreceptor comprises a hole transport compound selected from the group consisting of N,N'-diphenyl-N,N'-bis(3-methylphenyl)-(1,1'-biphenyl)-4,4'-diamine, N,N,N'N'-tetra(4-methylphenyl)-(1,1'-biphenyl)-4,4'-diamine, N,N'-bis(4-butylphenyl)-N,N'-di-p-tolyl-[p-terphenyl]-4,4"-diamine, and N,N'-bis(4-butylphenyl)-N,N'-di-m-tolyl-[p-terphenyl]-4,4"-diamine.

12. The imaging forming apparatus of claim 10, wherein the charging device is a biased charge roll.

13. The imaging forming apparatus of claim 10, wherein the photoreceptor wear-rate is from about 5 to about 15 nm/kcycles.

* * * * *